US007331574B2

(12) United States Patent
Soo

(10) Patent No.: US 7,331,574 B2
(45) Date of Patent: Feb. 19, 2008

(54) MEDIA INPUT SYSTEM

(75) Inventor: Eng-Leong Soo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 364 days.

(21) Appl. No.: 11/173,526

(22) Filed: Jun. 30, 2005

(65) Prior Publication Data

US 2007/0001373 A1 Jan. 4, 2007

(51) Int. Cl.
*B65H 3/06* (2006.01)

(52) U.S. Cl. ..... 271/117; 271/118; 271/162

(58) Field of Classification Search ..... 271/117, 271/118, 162

See application file for complete search history.

(56) References Cited

U.S. PATENT DOCUMENTS 5,215,299 A 6/1993 Luft
5,547,181 A 8/1996 Underwood
5,620,269 A 4/1997 Gustafson
5,716,047 A * 2/1998 Ohkoda et al. ..... 271/106
6,296,244 B1 10/2001 Hanks et al.
2003/0113148 A1 6/2003 Hoene et al.
2004/0109056 A1 6/2004 Kang
2004/0207145 A1* 10/2004 Chang ..... 271/117

* cited by examiner

*Primary Examiner*—Patrick Mackey
*Assistant Examiner*—Luis A Gonzalez

(57) ABSTRACT

A media input system for an image forming apparatus is disclosed. The media input system includes an input tray for holding a stack of media sheets, a scissor picking assembly for picking individual media sheets from the stack, and a transport roller assembly for transporting the picked media sheets to a media path in the image forming apparatus. The scissor picking assembly includes a pair of guide rails pivotally linked to a roller support frame. One end of the roller support frame is coupled to a pick roller shaft having at least one pick roller rigidly mounted thereon, while the other end is configured to pivotally mount to the housing of the image forming apparatus.

16 Claims, 7 Drawing Sheets

MEDIA INPUT SYSTEM

FIELD OF THE INVENTION

The present invention relates generally to media input systems for image forming apparatuses.

BACKGROUND

Many image forming apparatuses, such as printers and copiers, utilize one or more input trays for holding stacks of media sheets. A sheet feeding mechanism is typically mounted in the tray or in the housing of the image forming apparatus to separate and deliver individual media sheets from the media stack to a media path in the image forming apparatus. One known type of input tray takes the form of a rectangular bin having a slanted wall at the media output end. A known sheet feeding mechanism for this type of tray includes a support arm coupled to a power-driven pickup roller that rests on the stack of media sheets. When the pickup roller is activated, it acts by friction to push individual sheets laterally against and upwardly the slanted wall. Different drive motors and/or many unique parts, e.g. gears, belts, pulleys, swing arms, are often required to move the sheet delivery mechanism into a correct engaging position with the media stack and to drive the pickup roller.

Another type of input tray is a high-capacity input tray, which is capable of storing high volume of media, e.g. 2000 sheets or more. High-capacity input trays are used in order to reduce the amount of downtime due to reloading of the input trays. Normally, the media sheets are stacked on a lifting tray that displaces vertically as media sheets are removed from the stack by a sheet feeding mechanism. Two different motors are required for this type of high-capacity input tray: one to move the lifting tray and one to drive the sheet feeding mechanism. The above conventional designs for sheet delivery are complicated and costly to implement.

There exists a need for a media input system with a sheet delivery mechanism that does not require multiple drive motors or unique parts to operate, that is simple to implement and can be installed at a relatively low cost.

SUMMARY

The present invention provides a media input system for an image forming apparatus. The media input system includes an input tray for holding a stack of media sheets, a scissor picking assembly for picking individual media sheets from the stack, and a transport roller assembly for transporting the picked media sheets to a media path in the image forming apparatus. The scissor picking assembly includes a pair of guide rails, a roller support frame and a common gear shaft. The guide rails and the roller support frame are pivotally connected to the common gear shaft so that the guide rails and the support frame can pivot about the longitudinal axis of the common gear shaft in a scissor-like fashion. One end of the roller support frame is coupled to a pick roller shaft having at least one pick roller ridgidly mounted thereon. One end of each guide rail is pivotally connected to the transport roller assembly, while the other end is freely movable. A first gear train is mounted on one guide rail so as to provide driving engagement between the transport roller assembly and the common gear shaft. A second gear train is mounted on the roller support frame so as to provide driving engagement between the common gear shaft and the pick roller shaft.

The objects and advantages of the present invention will become apparent from the detailed description when read in conjunction with the drawings.

DETAILED DESCRIPTION

Figure 1:
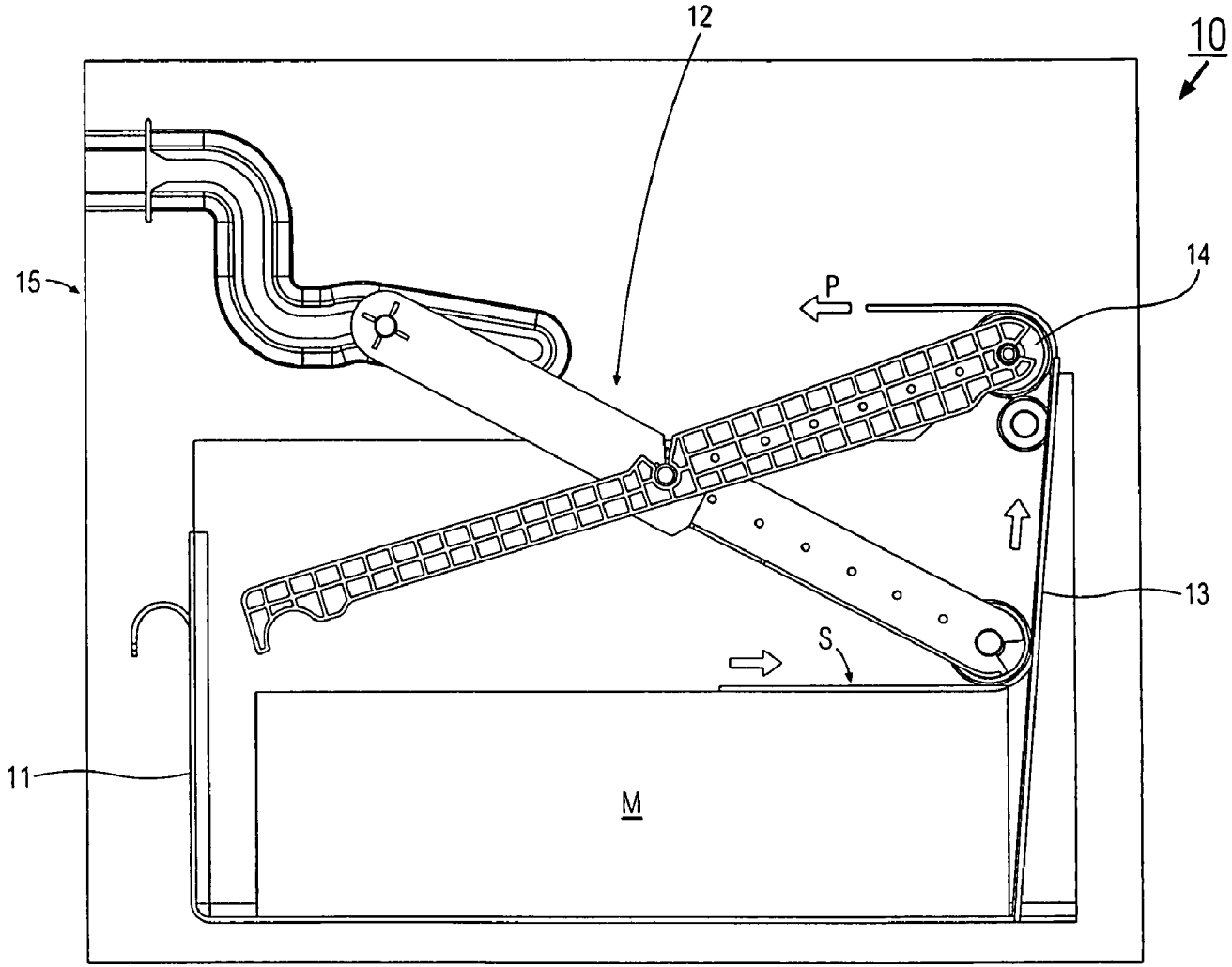
FIG. 1 is a side view of a media input system according to an embodiment of the present invention.

FIG. 1 illustrates a media input system 10 according to one embodiment of the present invention. The media input system 10 is suitable for use in any image forming apparatus capable of forming a visual image on a media sheet, such as an inkjet printer, or a copier. The term "media sheet" is intended to encompass all form of print media including paper, transparencies, etc. Referring to FIG. 1, the media input system 10 includes an input tray 11 for holding a stack of media sheets (M), a scissor picking assembly 12 for picking the uppermost media sheet S from the media stack M to a media path P (indicated by the arrow P), an inclined guide wall 13, and a transport roller assembly 14. The scissor picking assembly 12 and transport roller assembly 14 are mounted to the housing of the image forming apparatus; only a wall section 15 thereof is shown for illustration.

Figure 2:
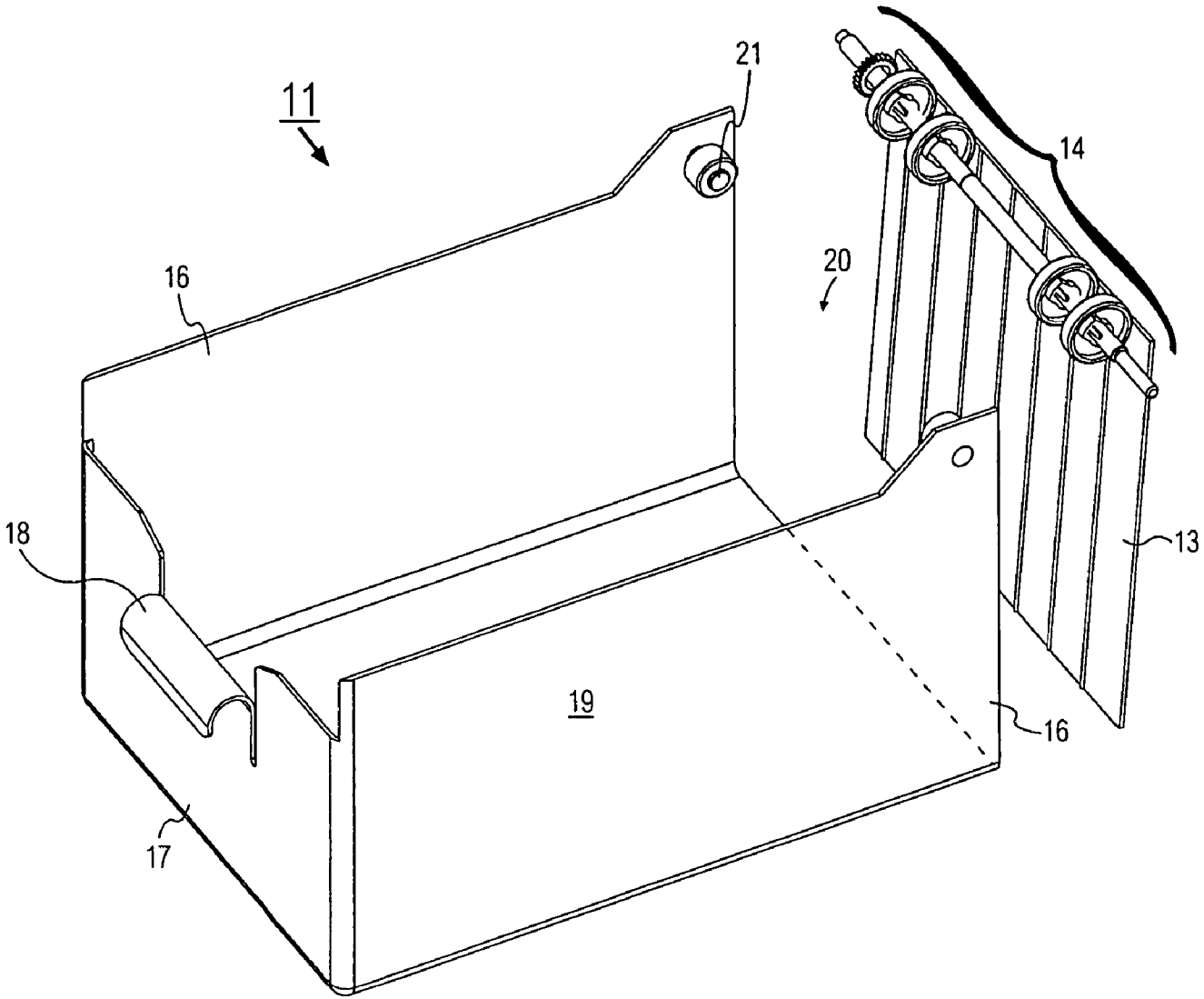
FIG. 2 is a perspective view of the input tray, which is part of the media input system of FIG. 1 according to an embodiment of the present invention.

Referring to FIG. 2, the input tray 11 has two opposing side walls 16, a front wall 17 with a handle 18, a base 19, and an open output end 20. At the open output end of the input tray, a bearing 21 is mounted at the top corner of each side wall 16 as shown in FIG. 2.

Figure 3:
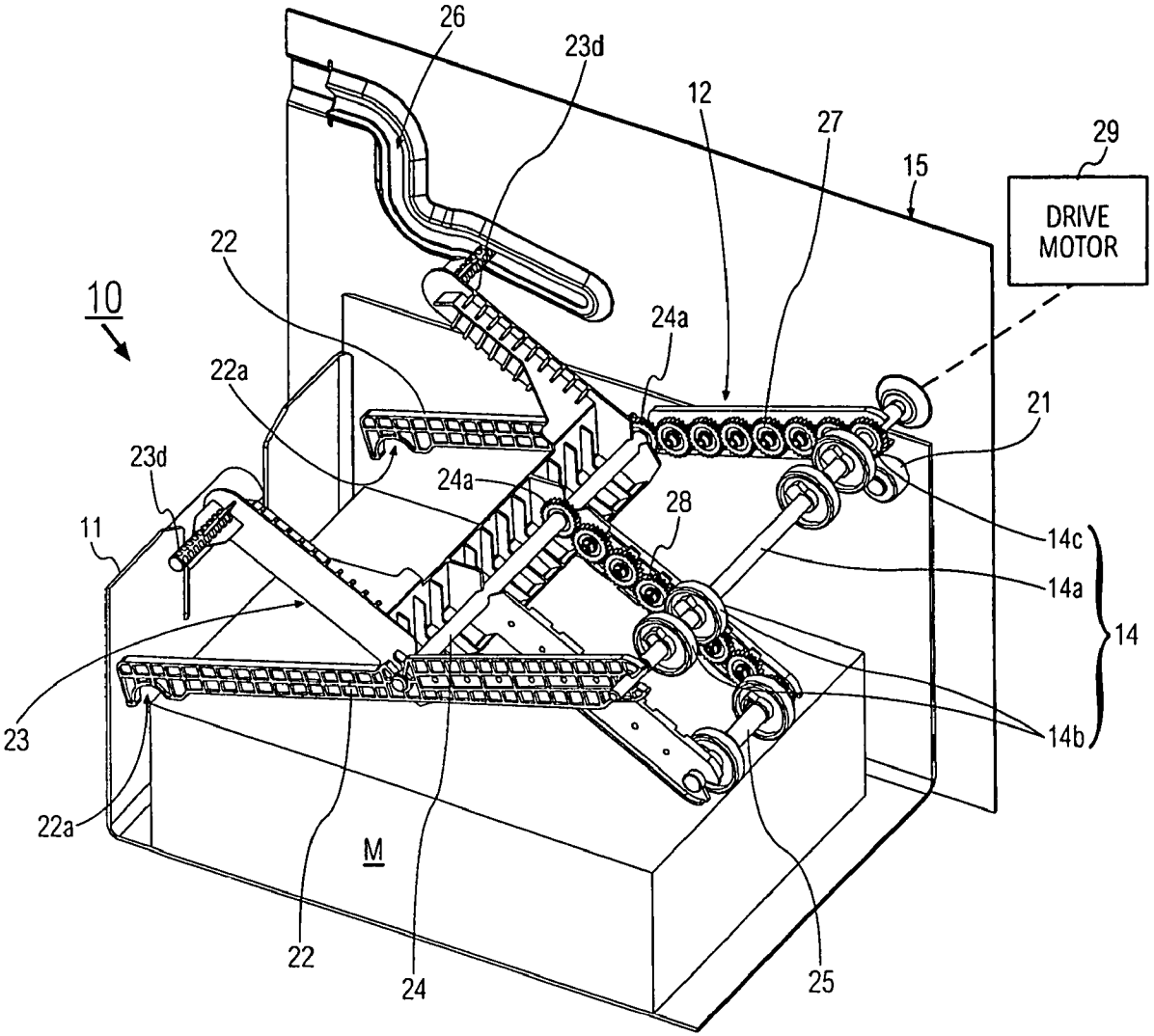
FIG. 3 is perspective view of the scissor picking assembly, which is part of the media input system of FIG. 1 according to an embodiment of the present invention.

Details of the scissor picking assembly 12 will now be described with reference to FIG. 3. The scissor picking assembly 12 includes a pair of substantially parallel guide rails 22 linked to a roller support frame 23 in a scissor-type linkage. The guide rails 22 and the roller support frame 23 are pivotally connected to a common gear shaft 24 such that the guide rails and the roller support frame can pivot about the longitudinal axis of the common gear shaft in a scissor-like fashion. A pick roller shaft 25 is rotatably coupled to one end of the roller support frame 23. The transport roller assembly 14 includes a rotatable transport roller shaft 14*a* with a plurality of transport rollers 14*b* and a coupling gear 14*c* rigidly mounted thereon. One end of each guide rail 22 is pivotally connected to the transport roller shaft 14*a*, while the other end is freely movable. The free end of each guide rail 22 has a notch 22*a*. The transport roller shaft 14*a* is mounted to the housing wall 15 by conventional means.

A drive motor 29 is coupled to the transport roller shaft 14*a* to cause rotation thereof. A first gear train 27 is mounted on one of the guide rails 22 to provide driving engagement between the transport roller assembly 14 and the common gear shaft 24. The coupling gear 14*c* of the transport roller shaft 14 meshes with the first gear train 27 on the guide rail 22. A second gear train 28 is mounted on the roller support frame 23 to provide driving engagement between the common gear shaft 24 and the pick roller shaft 25. By this arrangement, the first gear train 27 transfers the driving force from the transport roller shaft 14 to the common gear shaft 24, and the second gear train 28 transfers the driving force from the common gear shaft 24 to the pick roller shaft 25. When the drive motor is activated, the transport roller shaft 14*a* is driven to rotate, thereby causing the common gear shaft 24 to rotate, which in turn causing the pick roller shaft 25 to rotate.

Figure 4:
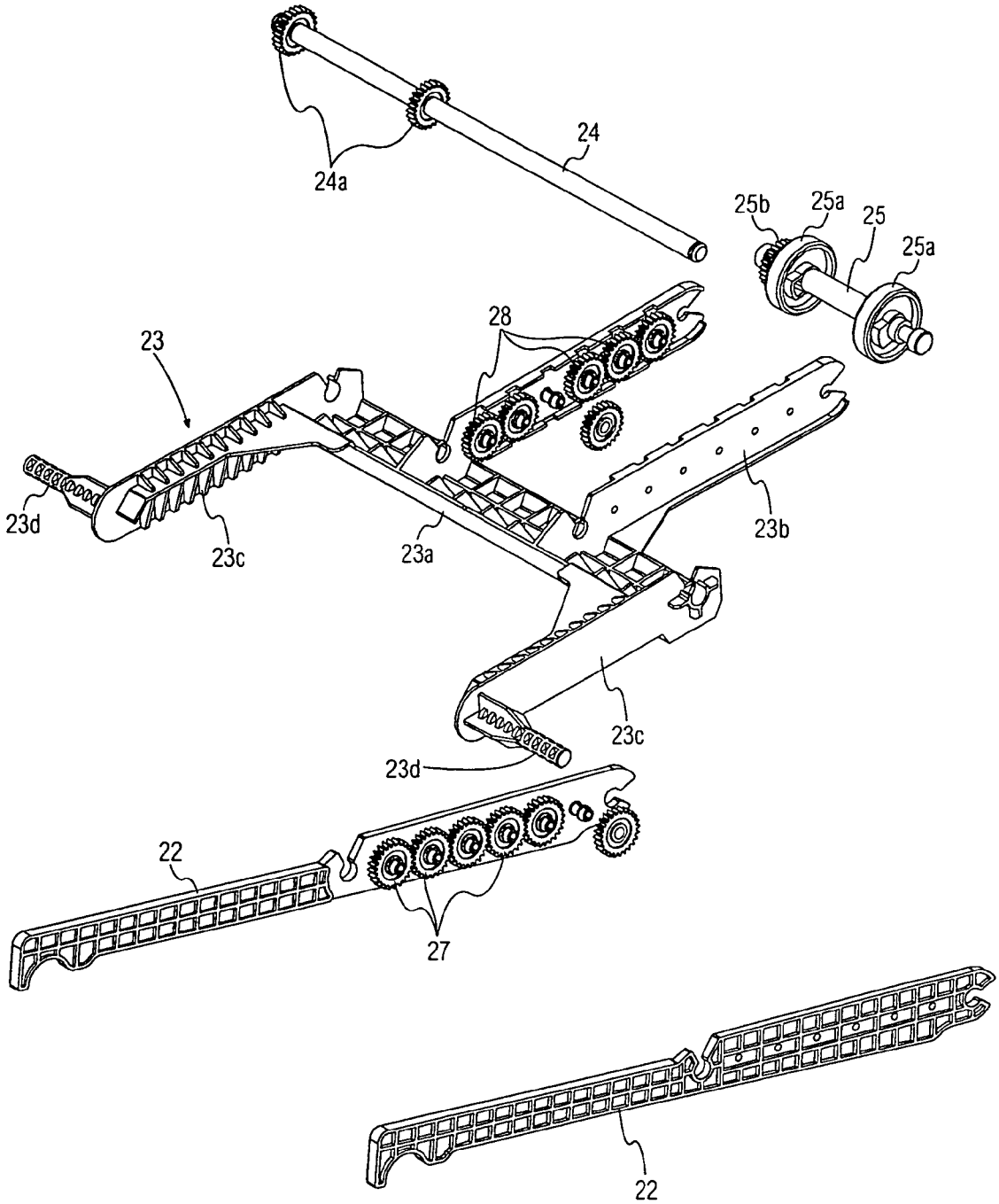
FIG. 4 shows the components of the scissor picking assembly in a disassembled state according to an embodiment of the present invention.

FIG. 4 shows an exploded view of the scissor picking assembly in a disassembled state. Referring to FIG. 4, the roller support frame 23 has a connecting frame portion 23*a* that extends along the longitudinal length of the common gear shaft 24, a pair of roller support arms 23*b* extending from the connecting frame portion in one direction, and a pair of connecting arms 23*c* extending in the opposite direction. The second gear train 28 is mounted onto one of the roller support arms 23*b*. The distal ends of the connecting arms are provided with pivot pins 23*d* that are configured so that the roller support frame 23 can be pivotally mounted to the housing. The pick roller shaft 25 is rotatably attached to the distal ends of the roller support arms 23*b*. Two pick rollers 25*a* and a coupling gear 25*b* are rigidly mounted onto the pick roller shaft 25. In an alternative embodiment, one elongated pick roller may be used instead of two pick rollers as shown.

Figure 5:
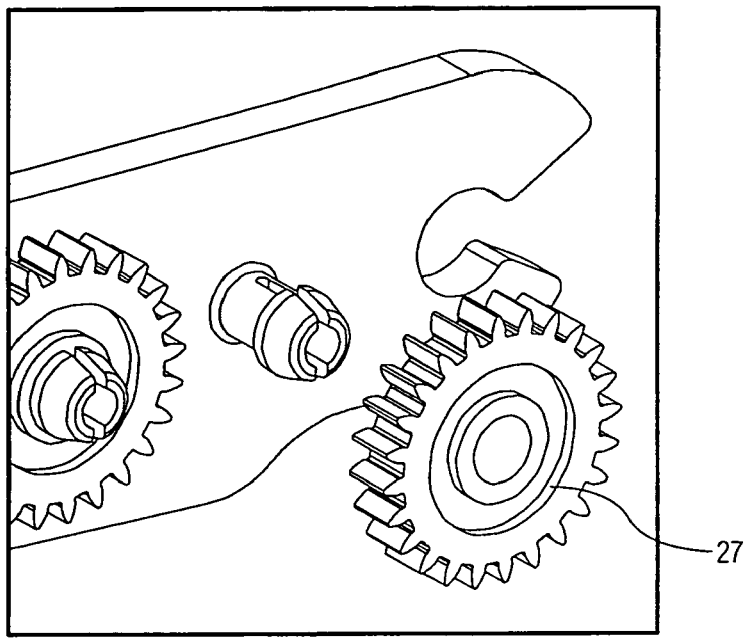
FIG. 5 is a close-up view of a snap-on gear that can be snapped onto a guide rail according to an embodiment of the present invention.

It will be understood by one skilled in the art that other number of pick rollers are possible depending on configuration. The common gear shaft 24 has two coupling gears 24*a* mounted thereon so as to mesh with the first gear train 27 and the second gear train 28. The coupling gear 25*b* of the pick roller shaft 25 meshes with the second gear train 28 on the roller support arm 23*b*. In one embodiment, the first gear train 27 and the guide rails 22 are configured so that the individual gears of the gear train can be snapped onto the guide rail 22 (illustrated by FIG. 5). Likewise, the second gear train 28 and the roller support frame 23 are configured so that the individual gears of the gear train can be snapped onto the roller support arm 23*b*. It will be understood by those skilled in the art that different number of gears are possible for the first and second gear trains depending on configuration.

Referring again to FIG. 3, an elongated slot 26 is formed in the housing wall section 15 to receive one of the pivot pins 23*d*. The other pivot pin is mounted to an opposite wall section (not shown) that is a mirror image of the housing wall section 15 shown. The slot 26 is configured so that the moving path of the pivot pin is guided by the slot. As the roller support frame 23 pivots about the slot pins, the weight distribution of the roller support frame 23 will ensure that the roller support frame 23 biases clockwise about the pivot pins 23*d*.

Figure 6A:
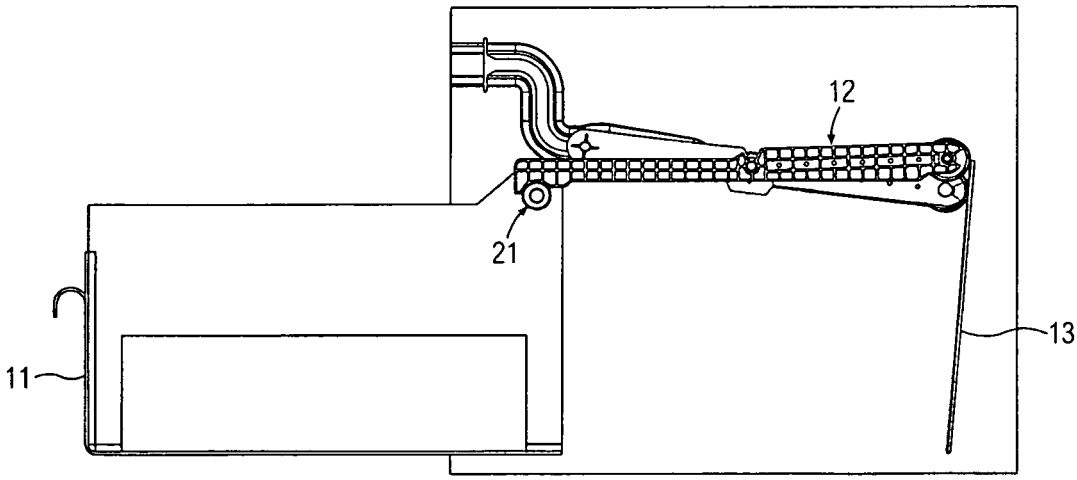
FIG. 6A illustrates the position of the scissor picking assembly when the input tray is at its maximum pulled-out position according to an embodiment of the present invention.
Figure 6B:
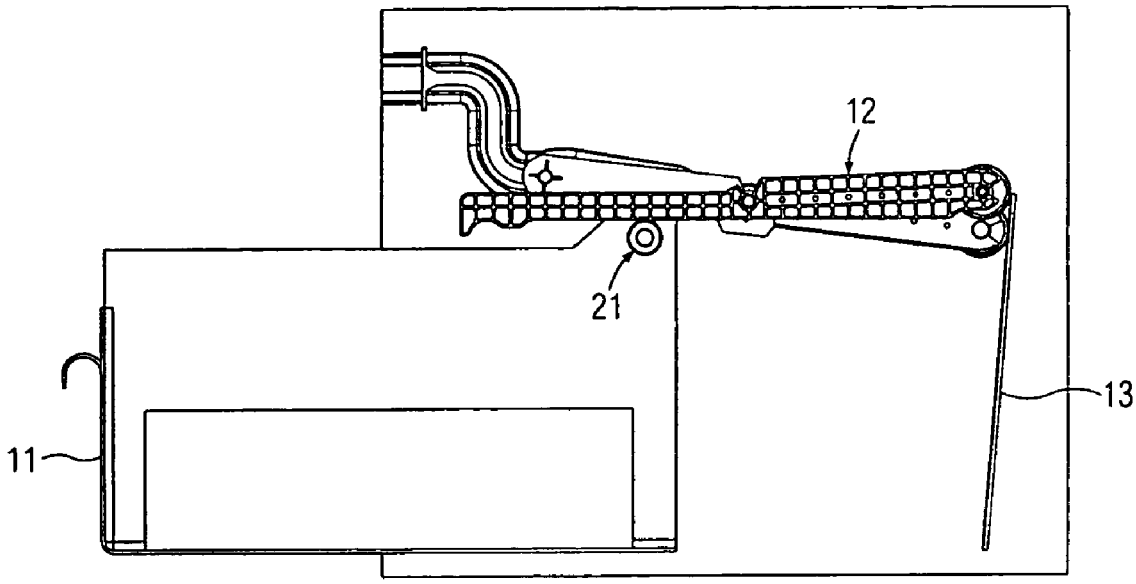
FIG. 6B illustrates the position of the scissor picking assembly when the input tray is in the transition stage between the maximum pulled-out position and the fully inserted position according to an embodiment of the present invention.
Figure 6C:
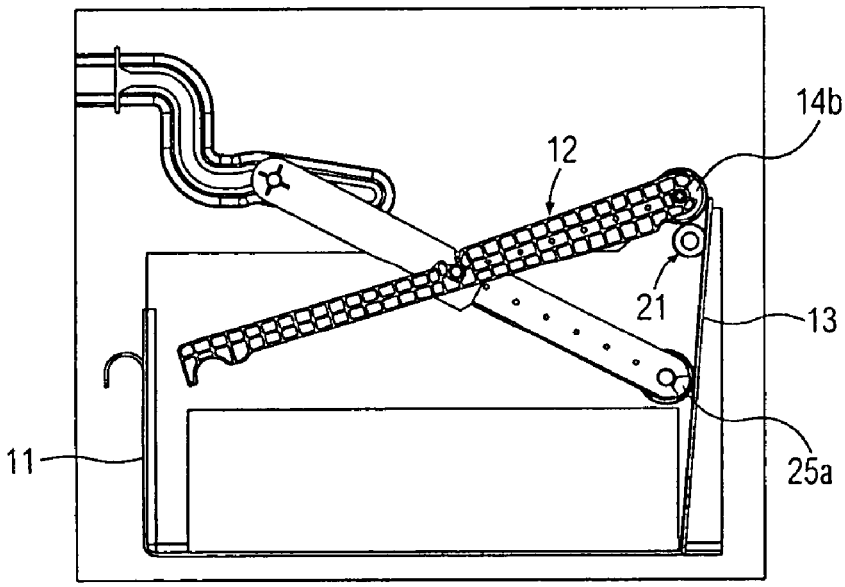
FIG. 6C illustrates the position of the scissor picking assembly when the input tray is fully inserted with a stack of media sheet therein according to an embodiment of the present invention.

FIGS. 6A-6C shows the position of the scissor picking assembly 12 relative to the input tray 11 at various stages. The scissor picking assembly is mounted to the housing of the image forming apparatus so that it is vertically extendable and foldable. Referring to FIG. 6A, when the input tray is pulled out from the housing for loading of the media sheets, the scissor picking assembly 12 is in a folded position. FIG. 6B illustrates the position of the scissor picking assembly during the transition between the maximum pulled-out position and the fully inserted position of the input tray. When the input tray is fully inserted, the scissor picking assembly extends to its most extendable position allowable by its own weight over the media stack, and the pick rollers 25*a* rest on the uppermost media sheet (FIG. 6C).

As can be seen from FIGS. 6A-6C, the inclined guide wall 13 is not attached to the input tray 11, and is positioned in the housing so that, when the input tray is fully inserted into the housing (as shown in FIG. 6C), the guide wall forms an inclined rear wall at the open output end of the input tray to guide the individual media sheets from the media stack to the transport roller assembly 14. The moment when the input tray is fully inserted with the media stack therein (FIG. 6C), the scissor picking assembly 12 is in a "ready state" position, i.e., the pick rollers 25*a* are ready to pick up the uppermost media sheet. When the drive motor is activated, the pick rollers 25*a* act by friction to push the uppermost media sheet from the media stack laterally against and upwardly the inclined guide wall 13. The transport rollers 14*b* then convey the separated media sheet to the media path. By this arrangement, the start-up time of the image forming apparatus is reduced.

Figure 7:
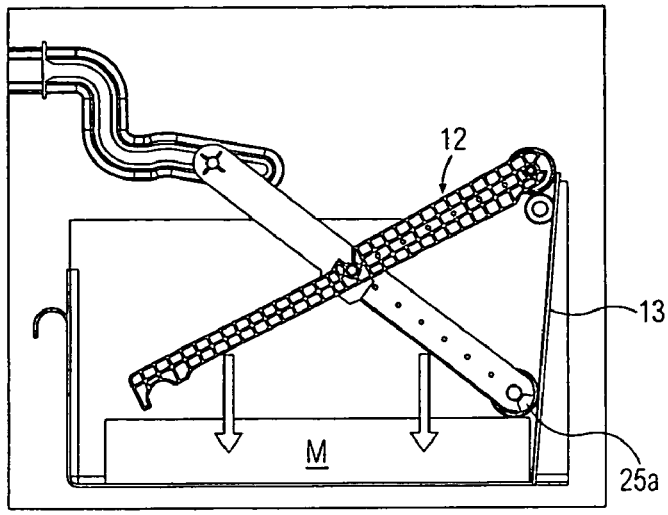
FIG. 7 illustrates the position of the scissor picking assembly when the size of the media stack is reduced according to an embodiment of the present invention.

Referring to FIG. 7, as the size of the media stack reduces, the scissor picking assembly 12 extends vertically by its own weight distribution, thereby maintaining the pick rollers 25*a* in constant contact with the uppermost sheet. In the event of an empty input tray, the pick rollers will contact the bottom of the input tray.

Figure 8:
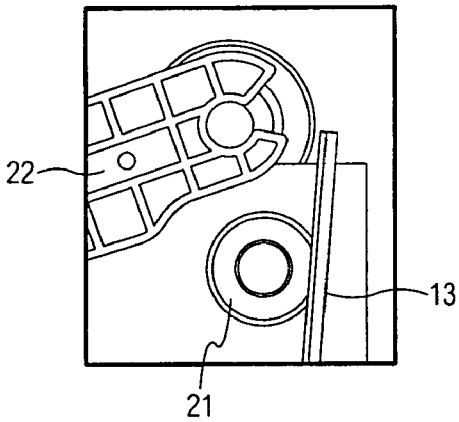
FIG. 8 is a close-up view showing the position of a bearing on the input tray relative to the guide rail when the input tray is fully inserted according to an embodiment of the present invention.
Figure 9:
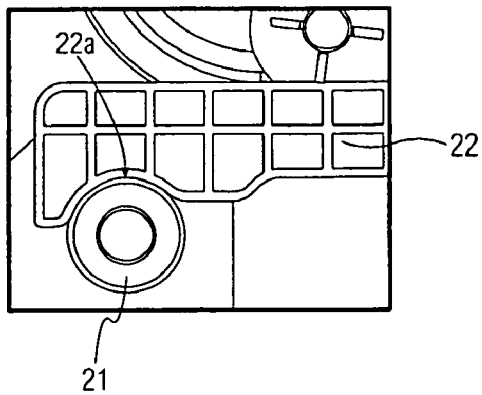
FIG. 9 is a close-up view showing the locking position of the bearing and the guide rail when the input tray is at its maximum pulled-out position according to an embodiment of the present invention.

Referring again to FIG. 6A, when the input tray is being pulled out, the bearings 21 engage the lower edges of the guide rails and slide underneath the guide rails, thereby causing the guide rails to pivot clockwise toward a horizontal position, until the notches 22*a* at the ends of the guide rails are in locking engagement with the bearings. When this locking engagement occurs, the input tray is in its maximum pulled-out position. FIG. 6B illustrates the position of the bearings 21 relative to the guide rails 22 during transition between the maximum pulled-out position and the fully inserted position. When the input tray 11 is fully inserted, the bearings 21 are disengaged from the guide rails 22 as shown in FIG. 8. FIG. 9 is a zoom-in view of the locking position of the guide rails 22.

By the above described design of the media input system, only one common drive motor and a relatively few number of parts are required. As a consequence, the chance of motor failure and mechanical failure is reduced. The parts could be designed so that they can be assembled by snapping together different parts, and screws are not required. In this way, the individual parts can be separately replaced and repaired. Furthermore, the input system of the present invention is capable of feeding a low volume of media sheets, e.g. about 200-500 sheets, or a large volume of media sheets, e.g. more than 2000 sheets. Overall, the media input system of the present invention is an economical design.

While particular embodiments of the present invention has been disclosed in detail in the foregoing description and drawings, it will be understood by those skilled in the art that variations and modifications thereof can be made without departing from the scope of the invention as set forth in the following claims.

What is claimed is:

1. A media input system comprising:

an input tray for holding a stack of media sheets;

a scissor picking assembly for picking individual media sheets from the stack, said scissor picking assembly comprising (a) a pair of guide rails, (b) a roller support frame, and (c) a common gear shaft; the guide rails and the roller support frame being pivotally connected to the common gear shaft such that the guide rails and the roller support frame can pivot about the longitudinal axis of the common gear shaft in a scissor-like fashion;

a transport roller assembly for transporting the picked sheets from the input tray to a media path, one end of each guide rail being pivotally connected to the transport roller assembly, while the other end of the guide rail being freely movable;

a pick roller shaft having at least one pick roller ridgidly mounted thereon, one end of the roller support frame being coupled to said pick roller shaft;

a first gear train mounted on one guide rail so as to provide driving engagement between the transport roller assembly and the common gear shaft;

a second gear train mounted on the roller support frame so as to provide driving engagement between the common gear shaft and the pick roller shaft.

2. The media input system of claim 1, wherein the transport roller assembly comprises a transport roller shaft having a plurality of transport rollers rigidly mounted thereon.

3. The media input system of claim 1, wherein the pick roller shaft has two pick rollers rigidly mounted thereon.

4. The media input system of claim 1, wherein the first gear train comprises a plurality of gears that can be snapped onto the guide rail and the second gear train comprises a plurality of gears that can snapped onto the roller support frame.

5. The media input system of claim 1, wherein the roller support frame comprises a connecting frame portion that extends along the longitudinal length of the common gear shaft and a pair of roller support arms extending from the connecting frame portion, and wherein the pick roller shaft is rotatably coupled to said roller support arms.

6. The media input system of claim 5, wherein the roller support frame further comprises a pair of connecting arms extending from the common frame portion, the distal ends of the connecting arms being provided with pivot pins that can be pivotally mounted to a housing.

7. The media input system of claim 1 further comprising an inclined guide wall for directing the picked media sheets toward the transport roller assembly.

8. A printing apparatus comprising the media input system of claim 1.

9. An image forming apparatus comprising:

a housing;

an input tray for holding a stack of media sheets, said input tray being slidable into and out of the housing; and a scissor picking assembly for picking an uppermost media sheet from the stack, said scissor picking assembly comprising a pair of guide rails pivotally linked to a roller support frame in a scissor-like linkage, one end of said roller support frame being coupled to a rotatable pick roller shaft having at least one pick roller rigidly mounted thereon, wherein the scissor picking assembly is mounted in the housing so that it is vertically extendable and foldable, whereby, when the input tray is pulled out of the housing, the scissor picking assembly is in a folded position, and when the input tray is fully inserted with the stack of media sheets therein, the scissor picking assembly extends to its most extendable position allowable by its own weight over the stack with said at least one pick roller resting on top of the stack.

10. An image forming apparatus comprising:

a housing;

an input tray for holding a stack of media sheets, said input tray being slidable into and out of the housing;

a scissor picking assembly for picking an uppermost media sheet from the stack, said scissor picking assembly comprising a pair of guide rails pivotally linked to a roller support frame in a scissor-like linkage, wherein the scissor picking assembly is mounted in the housing so that it is vertically extendable and foldable, whereby, when the input tray is pulled out of the housing, the scissor picking assembly is in a folded position, and when the input tray is fully inserted with the stack of media sheets therein, the scissor picking assembly extends to its most extendable position allowable by its own weight over the stack;

a common gear shaft; and a pick roller shaft having at least one pick roller rigidly mounted thereon, wherein the guide rails and the roller support frame are pivotally connected to the common gear shaft such that the guide rails and the roller support frame can pivot about the longitudinal axis of the common gear shaft in a scissor-like fashion, and the pick roller shaft is rotatably coupled to one end of the roller support frame.

11. The image forming apparatus of claim 10 further comprising:

a transport roller assembly mounted to the housing, wherein one end of each guide rail is pivotally connected to the transport roller assembly, while the other end of the guide rail is freely movable.

12. The image forming apparatus of claim 11, wherein the roller support frame comprises a pair of connecting arms, the distal ends of the connecting arms being provided with pivot pins that are pivotally mounted to the housing.

13. The image forming apparatus of claim 12, wherein the housing comprises an elongated slot to receive the pivot pins.

14. The image forming apparatus of claim 11 further comprising:

a first gear train mounted on one of the guide rails to provide a driving engagement between the transport roller assembly and the common gear shaft;

a second gear train mounted on the roller support frame so as to provide driving engagement between the common gear shaft and the pick roller shaft; and a drive motor coupled to the transport roller assembly so that the transport roller shaft is driven to rotate when the drive motor is activated, thereby causing the common gear shaft to rotate, which in turn causing the pick roller shaft to rotate.

15. The image forming apparatus of claim 9, wherein the input tray comprises a front wall with a handle, a base, and two opposing side walls, each side wall having a bearing located at an upper corner that is not adjacent to the front wall, and each guide rail has a notch at one end, and wherein the scissor picking assembly is arranged so that, when the input tray is being pulled out, the bearings glide beneath the guide rails until the bearings and the notches in the guide rails are in locking engagement.

16. The image forming apparatus of claim 11 further comprising an inclined guide wall positioned adjacent to the transport roller assembly so as to direct the picked media sheet toward the transport roller assembly.

* * * * *